US007444705B2

(12) United States Patent
Chang

(10) Patent No.: US 7,444,705 B2
(45) Date of Patent: Nov. 4, 2008

(54) AIR BED

(75) Inventor: Tao-Wei Chang, Taipei (TW)

(73) Assignee: Krystal Star International Corporation, Taipei (TW)

( * ) Notice: Subject to any disclaimer, the term of this patent is extended or adjusted under 35 U.S.C. 154(b) by 63 days.

(21) Appl. No.: 11/448,028

(22) Filed: Jun. 7, 2006

(65) Prior Publication Data

US 2007/0283500 A1 Dec. 13, 2007

(51) Int. Cl.
*A47C 27/08* (2006.01)

(52) U.S. Cl. ..... 5/713; 5/308; 5/904; 5/905

(58) Field of Classification Search ..... 5/308, 5/639, 904–905
See application file for complete search history.

(56) References Cited

U.S. PATENT DOCUMENTS 4,841,587 A * 6/1989 Carter et al. ..... 5/419
4,972,533 A * 11/1990 Brown ..... 5/413 R
5,063,912 A * 11/1991 Hughes ..... 601/47
6,568,012 B2 * 5/2003 Michaelis et al. ..... 5/706

* cited by examiner

*Primary Examiner*—Fredrick Conley
(74) *Attorney, Agent, or Firm*—Troxell Law Office, PLLC

(57) ABSTRACT

An air bed is disclosed. The air bed includes an air pump, an inflatable body and a cabinet detachably or fixedly connected to the inflatable body. The cabinet is a rollable and foldable airbag having at least one valve for inflation and deflation and includes at least one recess for receiving an air pump and other articles.

12 Claims, 7 Drawing Sheets

AIR BED

FIELD OF THE INVENTION

The present invention relates to an air bed and, more particularly, to an air bed which has a cabinet for receiving an air pump and other articles.

BACKGROUND OF THE INVENTION

An air bed is often used as a camp bed or a piece of household furniture due to its light weight and flexibility. It is also easy to be stored after deflated.

Nowadays many types of air bed exist. As shown in FIG. 5, such an air bed typically includes an inflatable mattress 2 having a bolster 214, a valve 212, and an air tap 213. The inflatable mattress 2 must be equipped with an air pump 211, which is connected to the valve 212 to pump air into the interior of the mattress 2 during inflation and is disconnected from the valve 212 after the inflation. Although the pump 211 can perform its main function, the arrangement of the pump 211 at side of the mattress 2 during the inflation may trip the user up and thus may bring damage to itself. Furthermore, the separate arrangement may also cause the user to miss the pump 211 after taking the mattress 2 with him/her and going to a destination faraway.

With the development of science and technology, more and more new types of air bed have been developed. However, these conventional beds may not attract the attention of potential customers because they have only an inflatable mattress without any audio equipments which can cooperate with personal audio devices of the user.

Furthermore, when the user bivouacs in the field, the conventional air bed provides only a place for the user to lie on. It provides no proper place to hold personal belongings of the user, such as the clothes taken off from the user, and provides no luminous source.

Therefore, there is a need for an improved air bed to overcome the shortcomings of the prior art.

OBJECTIVES OF THE INVENTION

It is an objective of the present invention to provide an air bed which has a cabinet formed with at lease one recess for receiving articles.

It is a further objective of the present invention to provide an air bed which has a cabinet for receiving and protecting an air pump.

Still another objective of the present invention is to provide an air bed which has a cabinet provided with speakers having an audio cable ending in a plug adapted to be plugged into a jack of a personal audio device.

Still another objective of the present invention is to provide an air bed which has a cabinet provided with a set of LED lamps for illumination.

SUMMARY OF THE INVENTION

To achieve the aforementioned objectives, the present invention provides an air bed including an air pump, an inflatable body and a cabinet detachably or fixedly connected to the inflatable body. Wherein said inflatable body is a mattress air chamber for inflation and weight-bearing, having at least one valve for inflation and deflation. Said cabinet is detachably or fixedly connected to one end of said inflatable body, provided with at least one recess for receiving articles and air pump, and is a rollable and foldable airbag having at least one valve for inflation and deflation.

As one aspect of the present invention, the cabinet is provided with speakers which have an audio cable ending in a plug adapted to be plugged into a jack of a personal audio device.

As another aspect of the present invention, the cabinet is provided with a set of LED lamps for illumination.

Other objectives, advantages and novel features of this invention will become more apparent from the following detailed description when taken in conjunction with the accompanying drawings.

DETAILED DESCRIPTION OF THE PREFERRED EMBODIMENT

Figure 1:
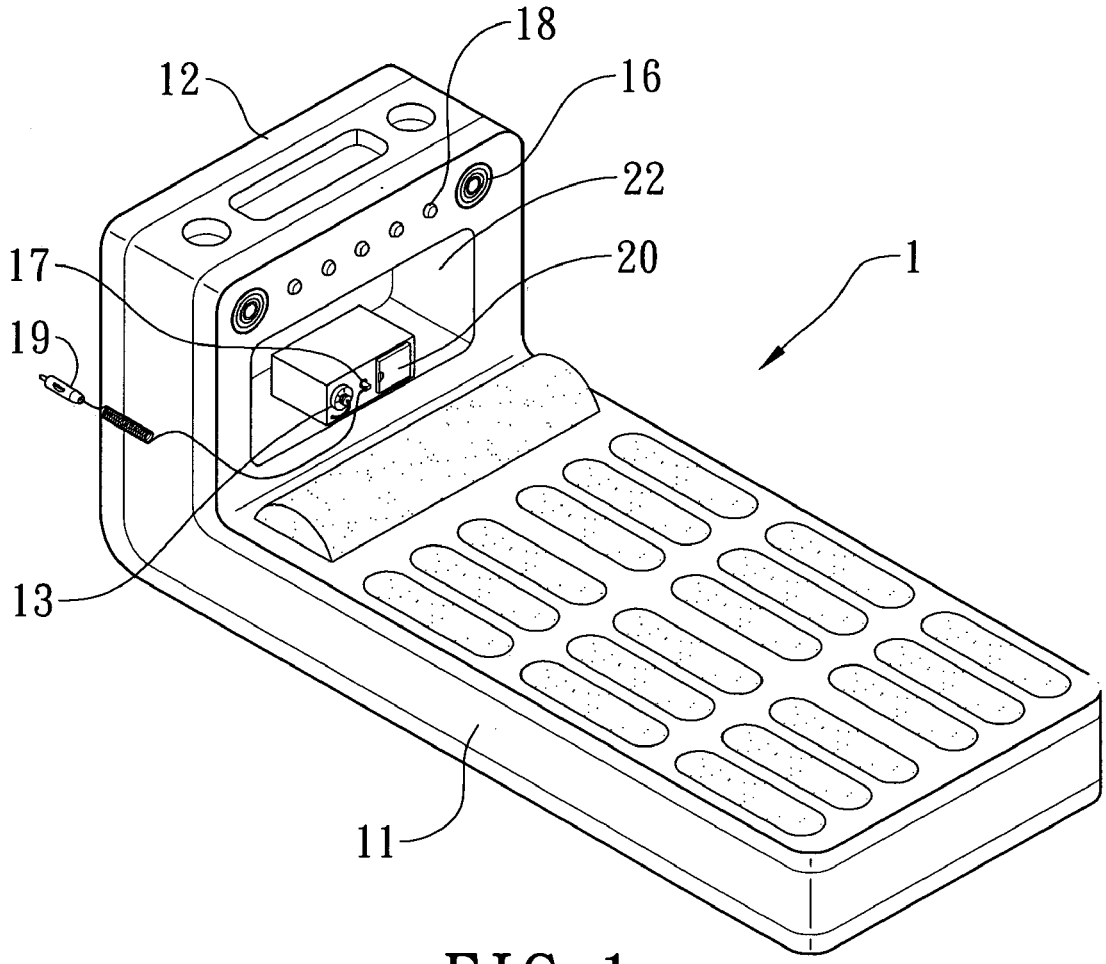
FIG. 1 is a perspective view of a first preferred embodiment of an air bed in accordance with the present invention.

Referring to FIG. 1, there is shown a first preferred embodiment of an air bed 1 in accordance with the present invention. The air bed 1 includes an inflatable body 11 and an cabinet 12. In the preferred embodiment, the air bed comprising the inflatable body 11 and the cabinet 12 is formed integrally and has a L-shaped configuration. The cabinet 12 includes at least one recess 22 for receiving an air pump 13 and other articles, which a user desires to place therein. The air pump 13 is preferably an electric pump capable of being energized either by at least one battery 20 or by an external power supply. Wherein the external power supply, such as an automobile cigarette lighter or an external power receptacle, is connected to a jack 17 of the air pump 13 through a power cord or a vehicle lighter adapter 19.

Additionally, the cabinet 12 includes a valve (not shown) normally connected to the air pump 13 for inflating the cabinet 12, and even the whole bed 1 if the inflatable body 11 and the cabinet 12 are formed integrally. This valve is also used for deflating the cabinet 12 and even the whole bed 1 after disconnected from the air pump 13.

Additionally, the cabinet 12 is provided with a pair of speakers 16, which is electrically connected to the air pump 13 so as to share a common power supply. The speakers 16 have an audio cable ending in a plug (not shown) adapted to be plugged into a jack of a personal audio device, such as a radio receiver, a personal CD player or an MP3. The cabinet 12 is further provided with a set of LED (light emitting diode) lamps 18 arranged thereon, and preferably the LED lamps 18 are supplied with an electric energy transformed from mechanical energy or the LED lamps 18 are electrically connected to the air pump 13 so as to share a common power supply.

Figure 2A:
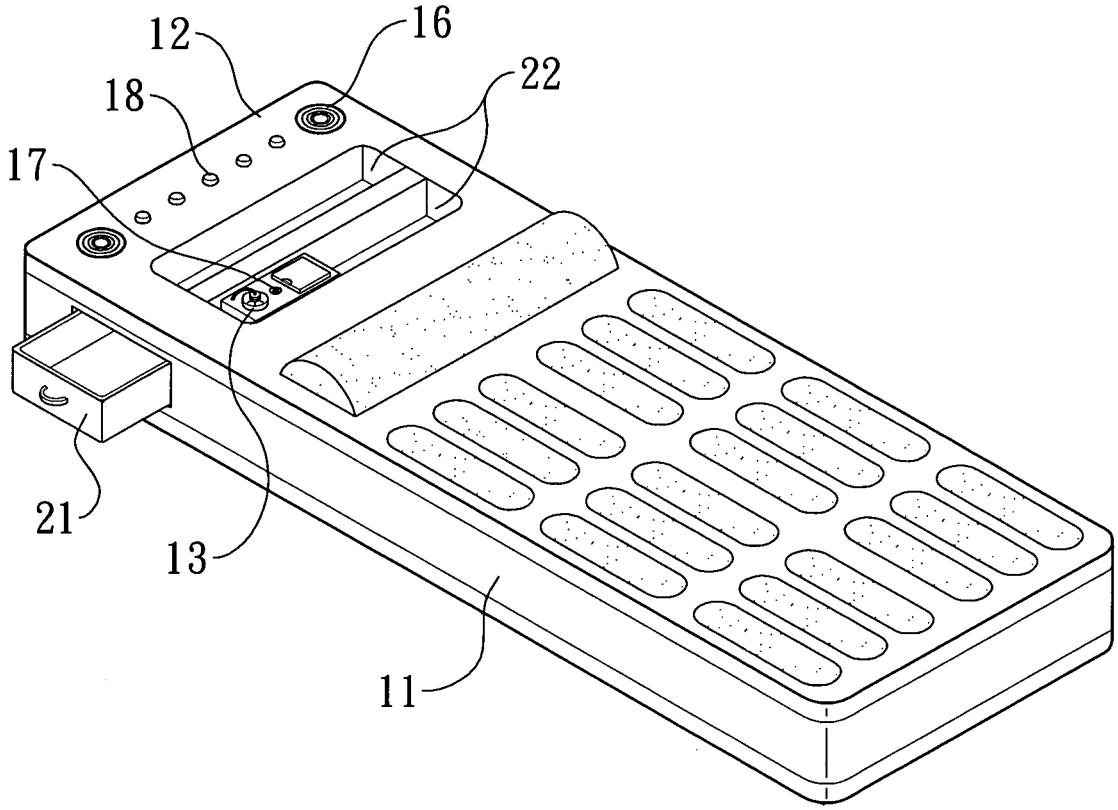
FIG. 2A is a perspective view of a second preferred embodiment of the inventive air bed.
Figure 2B:
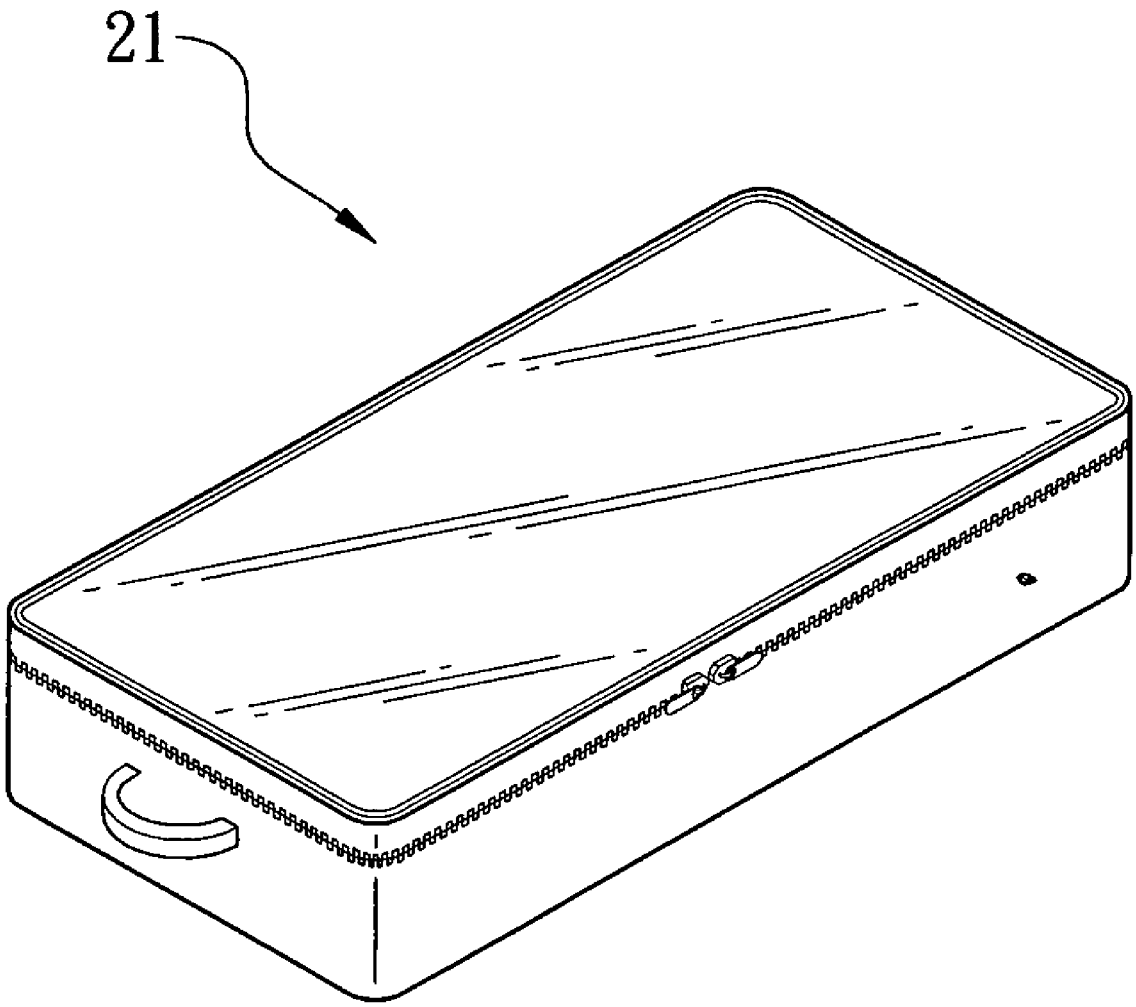
FIG. 2B is a view showing the air bed of FIG. 2A in store after deflation.

Referring to FIG. 2A, a second preferred embodiment of the inventive air bed 1 is similar to the above-mentioned first embodiment except that the air bed 1 now has a flat configuration instead of the L-shaped configuration. In addition, the cabinet 12 here has an additional recess for receiving a drawer 21, in which the air bed 1 can be held after deflated, as shown in FIG. 2B. Preferably, the drawer 21 has a cover attachable thereto; such as by means of a zip fastener, and thereby securely confines the deflated air bed 1 within the drawer 21.

Figure 3:
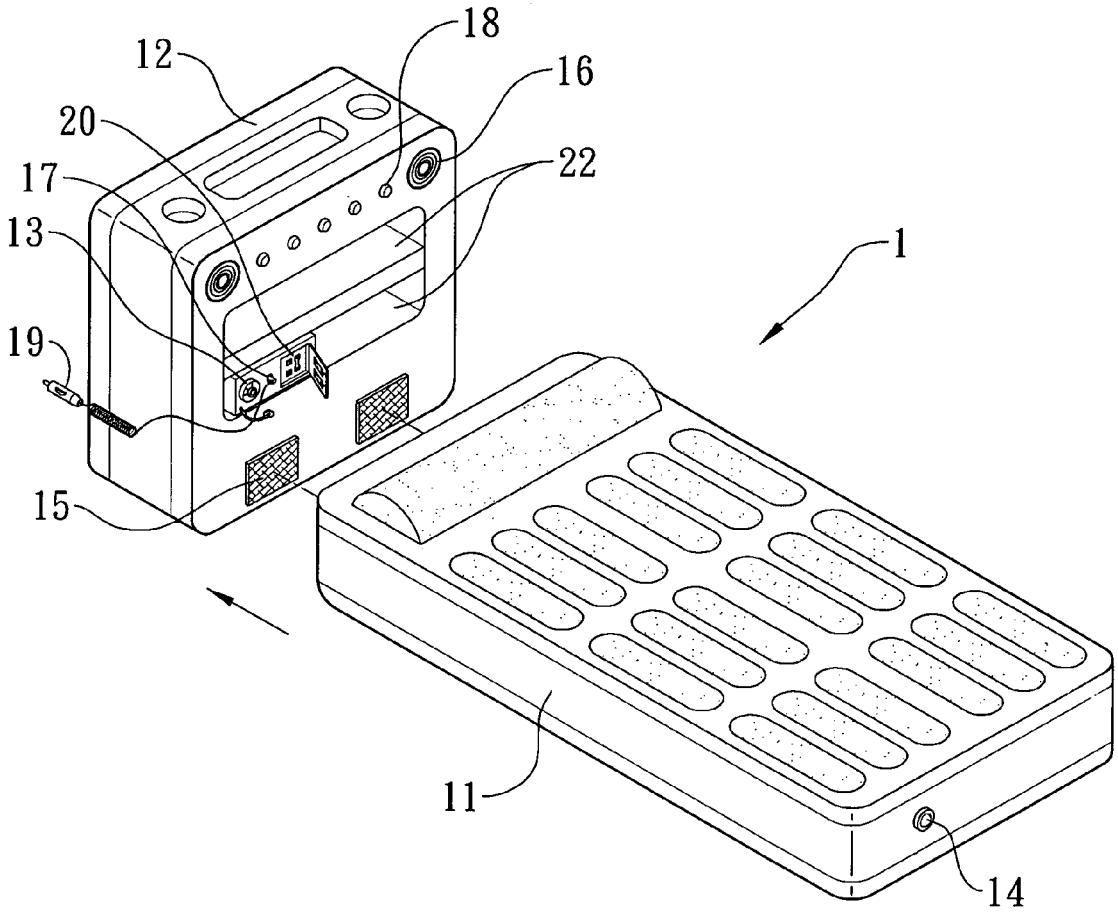
FIG. 3 is a perspective view of a third preferred embodiment of the inventive air bed.

Referring to FIG. 3, there is shown a third preferred embodiment of the inventive air bed 1. In this embodiment, however, the inflatable body 11 and the cabinet 12 are made separately and have at least one fastener 15, such as a magic tape, to detachably connect them together in such a manner that the air bed 1 is configured into a L-shaped bed. The fastener 15 here may have various configurations; it may also be selected from cord, buckle, zip fastener, clasp, or the like, though the magic tape is illustrated.

In this embodiment, the air pump 13 is fixed to the cabinet 12 or removable from the cabinet 12 in order to inflate the inflatable body 11 more easily through a valve 14 of the inflatable body 11.

Figure 4A:
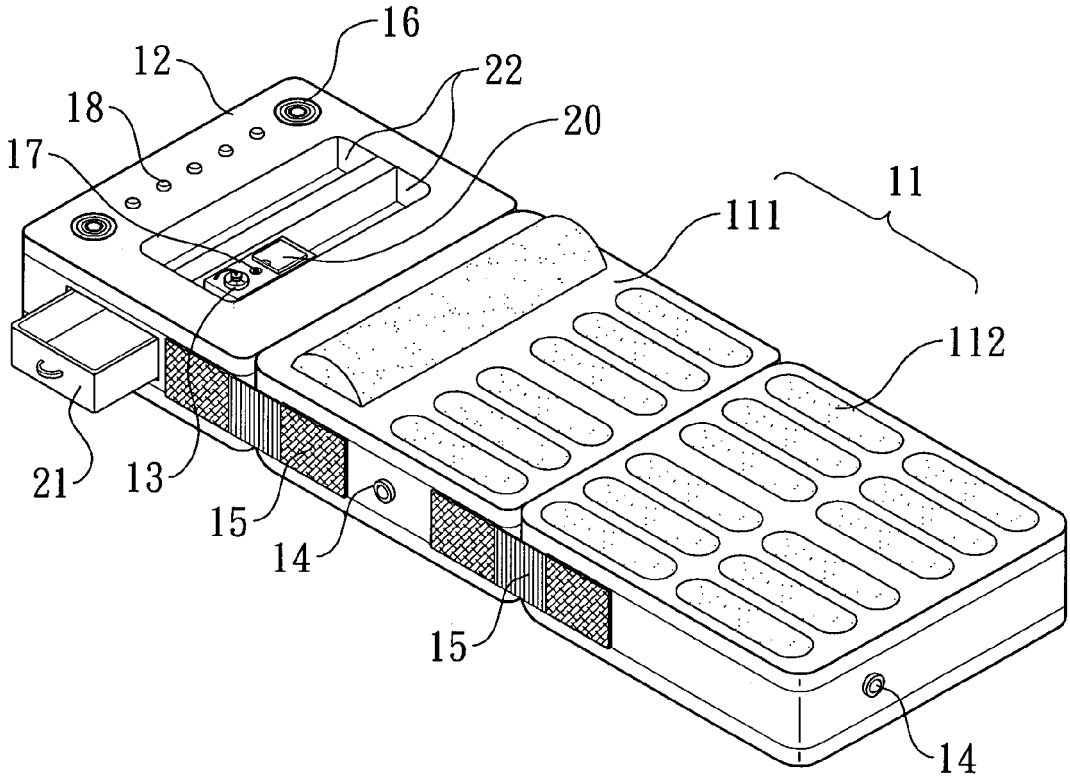
FIG. 4A is a perspective view of a fourth preferred embodiment of the inventive air bed in a configuration as a flat bed.
Figure 4B:
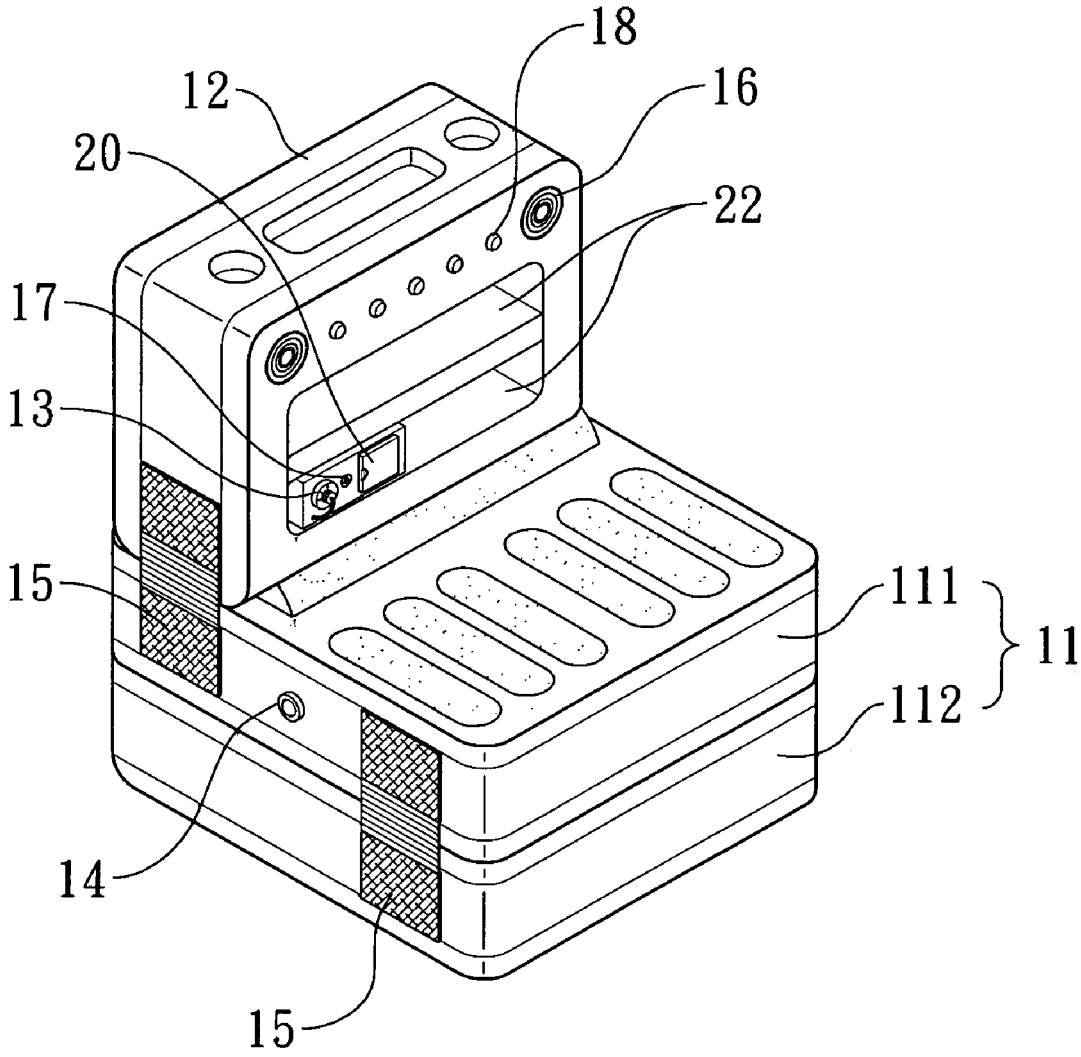
FIG. 4B is a perspective view showing the air bed of FIG. 4A in a configuration as a sofa.
Figure 5:
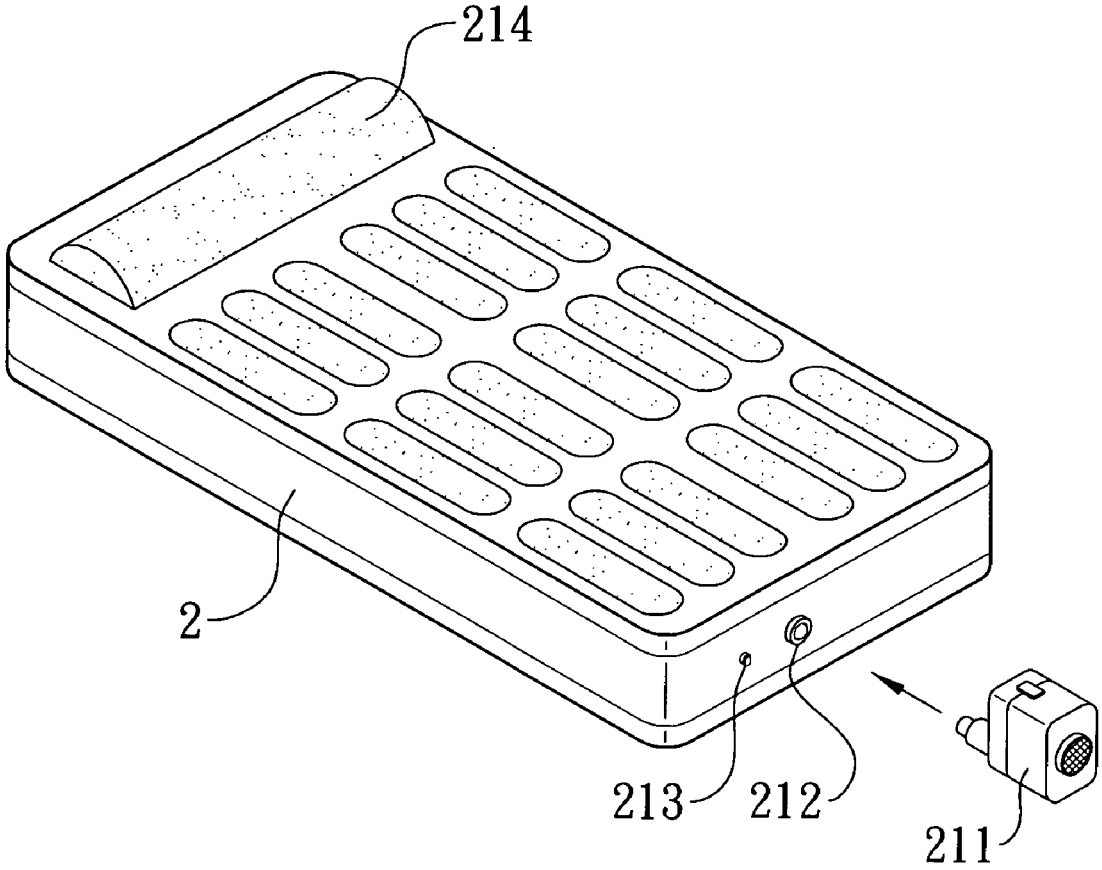
FIG. 5 (Prior Art)
FIG. 5 is a perspective view of an air bed of prior art.

Referring to FIG. 4A, there is shown a fourth preferred embodiment of the inventive air bed 1. In the embodiment here, the inflatable body 11 includes a first inflatable portion 111 and a second inflatable portion 112 which are made separately from each other, as well as separately from the cabinet 12. These inflatable portions 111 and 112, together with the cabinet 12, have a plurality of fasteners 15, such as magic tapes, to detachably connect them together in such a manner that the air bed 1 may be configured either as a flat bed, as shown in FIG. 4A, or as a sofa, as shown in FIG. 4B.

Referring back to FIG. 1, the inventive air bed 1 can be inflated by turning on the air pump 13, which is energized by at least one battery 20 or a external power supply. Wherein the external power supply, such as an automobile cigarette lighter or an external power receptacle, is connected to a jack 17 of the air pump 13 through a power cord or a vehicle lighter adapter 19. The air pump 13 placed in the recess 22 will pump air into the interior of the air bed 1 and make both the inflatable body 11 and the cabinet 12 swell to a desired extend. Since then, the user may lie on the inflated body 11 and place articles in the recess 22 of the cabinet 12. The inventive air bed 1 can also be deflated and stored in the drawer 21, as shown in FIG. 2B.

A separated storage case of a drawer, bag or box may be further provided for holding or storing the air bed after deflation, and the separated storage case may be received in the at least one recess of the cabinet.

Although embodiments together with structures and functions of the present invention have been described in detail, many modifications and variations may be made from the teachings disclosed hereinabove. Therefore, it should be understood by those skilled in the art that any modification and variation equivalent to the spirit of the present invention be regarded to fall into the scope coved by the appended claims.

What is claimed is:

1. An air bed comprising:

an inflatable body, said inflatable body is a mattress air chamber for inflation and weight-bearing, having at least one valve for inflation and deflation;

an air pump; and a cabinet located on one end of said inflatable body and said cabinet is a rollable and foldable airbag having at least one valve for inflation and deflation;

wherein said cabinet further includes at least one recess, said air pump is selectively inserted into the at least one recess.

2. The air bed as claimed in claim 1, further comprising at least one fastener, said inflatable body and said cabinet are made separately and detachably connected together by said at least one fastener.

3. The air bed as claimed in claim 2, wherein said fastener is selected from a group consisting of cord, buckle, zip fastener, clasp and magic tape.

4. The air bed as claimed in claim 1, wherein said air pump is an electric pump, and wherein said electric pump is energized by at least one battery.

5. The air bed as claimed in claim 1 wherein said air pump is an electric pump, and wherein said electric pump is energized by an external power supply through one of a power cord and a vehicle lighter adapter.

6. The air bed as claimed in claim 1, wherein said cabinet is provided with speakers electrically connected to said air pump and share a common power supply, said speakers are located in the cabinet adjacent to said at least one recess.

7. The air bed as claimed in claim 1, wherein said cabinet is provided with a set of LED lamps, energized by an electric energy transformed from mechanical energy.

8. The air bed as claimed in claim 1, wherein said cabinet is provided with a set of LED lamps electrically connected to said air pump and share a common power supply.

9. The air bed as claimed in claim 1, further comprising a storage case adapted to be received in one of said at least one recess of said cabinet, wherein said storage case is dimensioned to accommodate said air bed when said air bed is deflated.

10. The air bed as claimed in claim 9, wherein said storage case is selected from a group consisting of a drawer, bag, and box.

11. The air bed as claimed in claim 1, wherein the said inflatable body and said cabinet are integrally made together.

12. The air bed as claimed in claim 1, wherein the cabinet extends upwardly from the end of said inflatable body.

* * * * *